US009888322B2

(12) United States Patent
Warren

(10) Patent No.: US 9,888,322 B2
(45) Date of Patent: Feb. 6, 2018

(54) RECEIVER WITH COIL WOUND ON A STATIONARY FERROMAGNETIC CORE

(71) Applicant: Knowles Electronics, LLC, Itasca, IL (US)

(72) Inventor: Daniel Warren, Geneva, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 14/949,029

(22) Filed: Nov. 23, 2015

(65) Prior Publication Data

US 2016/0165354 A1 Jun. 9, 2016

Related U.S. Application Data

(60) Provisional application No. 62/088,197, filed on Dec. 5, 2014.

(51) Int. Cl.

| | |
|---|---|
| ***H04R 25/00*** | (2006.01) |
| ***H04R 11/04*** | (2006.01) |
| ***H04R 1/02*** | (2006.01) |
| ***H04R 3/08*** | (2006.01) |

(52) U.S. Cl.

CPC ..... *H04R 11/04* (2013.01); *H04R 1/02* (2013.01); *H04R 3/08* (2013.01); *H04R 2209/041* (2013.01)

(58) Field of Classification Search

USPC ..... 381/331

See application file for complete search history.

(56) References Cited

U.S. PATENT DOCUMENTS

| | | | |
|---|---|---|---|
| 1,799,510 | A | 4/1931 | Goldberg et al. |
| 3,002,058 | A | 9/1961 | Knowles |
| 3,515,818 | A | 6/1970 | Tibbetts |
| 3,588,383 | A | 6/1971 | Carlson et al. |
| 3,617,653 | A | 11/1971 | Tibbetts et al. |
| 3,935,398 | A | 1/1976 | Carlson et al. |
| 4,002,863 | A | 1/1977 | Broersma |

(Continued)

FOREIGN PATENT DOCUMENTS

| | | | |
|---|---|---|---|
| CN | 1314771 | A | 9/2001 |
| CN | 1910956 | A | 2/2007 |

(Continued)

OTHER PUBLICATIONS

International Search Report and Written Opinion for PCT/US2015/062418 dated Mar. 28, 2016 (9 pages).

(Continued)

*Primary Examiner* — Amir Etesam

(74) *Attorney, Agent, or Firm* — Faegre Baker Daniels LLP

(57) ABSTRACT

A receiver includes an acoustic module and a coil module. The acoustic module includes a first housing, a plurality of magnets, and an armature. The armature is disposed within the first housing and extends between the plurality of magnets. The coil module is coupled to the acoustic module, is physically separate from the acoustic module, and includes a second housing and a coil. The coil disposed within the second housing and does not surround the armature. The coil is excitable by an electrical current representative of acoustic energy and excitation of the coil produces a magnetic flux path which moves the armature.

9 Claims, 4 Drawing Sheets

(56) References Cited

U.S. PATENT DOCUMENTS

| | | | |
|---|---|---|---|
| 4,015,227 | A | 3/1977 | Riko et al. |
| 4,109,116 | A | 8/1978 | Victoreen |
| 4,272,654 | A | 6/1981 | Carlson |
| 4,410,769 | A | 10/1983 | Tibbetts |
| 4,450,930 | A | 5/1984 | Killion |
| 4,473,722 | A | 9/1984 | Wilton |
| 4,518,831 | A | 5/1985 | Stanley et al. |
| 4,628,907 | A | 12/1986 | Epley |
| 4,956,868 | A | 9/1990 | Carlson |
| 5,068,901 | A | 11/1991 | Carlson |
| 5,101,435 | A | 3/1992 | Carlson |
| 5,139,717 | A | 8/1992 | Peuckert et al. |
| 5,193,116 | A | 3/1993 | Mostardo |
| D360,691 | S | 7/1995 | Mostardo |
| D360,948 | S | 8/1995 | Mostardo |
| D360,949 | S | 8/1995 | Mostardo |
| 5,610,989 | A | 3/1997 | Salvage |
| 5,647,013 | A | 7/1997 | Salvage |
| 5,708,721 | A | 1/1998 | Salvage |
| 5,757,947 | A | 5/1998 | Van Halteren et al. |
| 5,809,158 | A | 9/1998 | Van Halteren et al. |
| 5,960,093 | A | 9/1999 | Miller |
| 6,041,131 | A | 3/2000 | Kirchhoefer |
| 6,075,870 | A | 6/2000 | Geschiere et al. |
| 6,078,677 | A | 6/2000 | Dolleman et al. |
| 6,654,477 | B1 | 11/2003 | Miller |
| 6,658,134 | B1 | 12/2003 | Van Hal et al. |
| 6,751,326 | B2 | 6/2004 | Nepomuceno |
| 6,757,403 | B2 | 6/2004 | Urushibata et al. |
| 6,801,632 | B2 | 10/2004 | Olson |
| 6,931,140 | B2 | 8/2005 | Van Halteren et al. |
| 7,050,602 | B2 | 5/2006 | Miller |
| 7,103,196 | B2 | 9/2006 | Warren |
| 7,136,500 | B2 | 11/2006 | Collins |
| 7,164,776 | B2 | 1/2007 | Miller |
| 7,203,334 | B2 | 4/2007 | Schafer |
| 7,236,609 | B1 | 6/2007 | Tsangaris |
| 7,305,098 | B2 | 12/2007 | Vonlanthen et al. |
| 7,336,797 | B2 | 2/2008 | Thompson |
| 7,362,878 | B2 | 4/2008 | Miller |
| 7,366,317 | B2 | 4/2008 | Miller |
| D573,588 | S | 7/2008 | Warren |
| 7,415,125 | B2 | 8/2008 | Warren |
| 7,443,997 | B2 | 10/2008 | Miller |
| 7,477,756 | B2 | 1/2009 | Wickstrom |
| 7,680,292 | B2 | 3/2010 | Warren |
| 7,747,032 | B2 | 6/2010 | Zei |
| 7,817,815 | B2 | 10/2010 | Miller |
| 7,860,264 | B2 | 12/2010 | Jiles |
| 7,869,610 | B2 | 1/2011 | Jayanth |
| 7,921,540 | B2 | 4/2011 | Jiles |
| 7,925,041 | B2 | 4/2011 | Jiles |
| 7,995,789 | B2 | 8/2011 | Tsangaris |
| 8,027,492 | B2 | 9/2011 | Miller |
| 8,135,163 | B2 | 3/2012 | Blanchard et al. |
| 8,233,646 | B2 | 7/2012 | Lutz |
| 8,284,964 | B2 | 10/2012 | Windischberger et al. |
| 8,385,583 | B2 | 2/2013 | Thompson |
| 8,401,215 | B2 | 3/2013 | Warren |
| 8,494,209 | B2 | 7/2013 | Miller |
| 8,594,351 | B2 | 11/2013 | Harlow et al. |
| 8,634,587 | B2 | 1/2014 | Nagumo et al. |
| 8,824,726 | B2 | 9/2014 | Miller |
| 8,837,755 | B2 | 9/2014 | Jiles |
| 8,995,705 | B2 | 3/2015 | van Reeuwijk |
| 9,137,605 | B2 | 9/2015 | Manley |
| 9,137,610 | B2 | 9/2015 | Jiles |
| 9,326,074 | B2 | 4/2016 | Jiles |
| 9,401,768 | B2 * | 7/2016 | Inha ..... H04M 1/7253 |
| 2001/0022844 | A1 | 9/2001 | Urushibata et al. |
| 2002/0003890 | A1 | 1/2002 | Warren |
| 2002/0061113 | A1 | 5/2002 | van Halteren et al. |
| 2002/0074995 | A1 | 6/2002 | Spellman |
| 2002/0142795 | A1 | 10/2002 | Imahori |
| 2003/0021454 | A1 | 1/2003 | Weyl |
| 2003/0021458 | A1 | 1/2003 | Hamada et al. |
| 2003/0190053 | A1 | 10/2003 | van Halteren |
| 2004/0258260 | A1 | 12/2004 | Thompson et al. |
| 2005/0152574 | A1 | 7/2005 | Van Banning |
| 2006/0083400 | A1 | 4/2006 | Miller |
| 2006/0133636 | A1 | 6/2006 | Harvey et al. |
| 2006/0159298 | A1 | 7/2006 | Von Dombrowski et al. |
| 2006/0227990 | A1 | 10/2006 | Kirchhoefer |
| 2007/0036378 | A1 | 2/2007 | Saltykov |
| 2007/0104340 | A1 | 5/2007 | Miller |
| 2007/0133834 | A1 | 6/2007 | vanHalteren |
| 2007/0223735 | A1 | 9/2007 | Lopresti |
| 2007/0230734 | A1 | 10/2007 | Beard |
| 2007/0258616 | A1 | 11/2007 | Tsangaris |
| 2008/0063223 | A1 | 3/2008 | Van Halteren et al. |
| 2008/0101640 | A1 | 5/2008 | Ballad |
| 2008/0205691 | A1 | 8/2008 | Beekman et al. |
| 2008/0226115 | A1 | 9/2008 | Beekman et al. |
| 2009/0060245 | A1 | 3/2009 | Blanchard et al. |
| 2009/0147983 | A1 | 6/2009 | Jiles |
| 2009/0214068 | A1 | 8/2009 | Wickstrom |
| 2009/0296971 | A1 | 12/2009 | Saltykov et al. |
| 2010/0034418 | A1 | 2/2010 | Bonin |
| 2010/0054509 | A1 * | 3/2010 | Thompson ..... H04R 11/02 381/312 |
| 2010/0067730 | A1 | 3/2010 | van Halteren et al. |
| 2010/0128905 | A1 | 5/2010 | Warren et al. |
| 2010/0284561 | A1 | 11/2010 | Miller |
| 2010/0310106 | A1 | 12/2010 | Blanchard |
| 2012/0008804 | A1 | 1/2012 | Bedwell et al. |
| 2012/0155694 | A1 | 6/2012 | Reeuwijk |
| 2013/0051580 | A1 | 2/2013 | Miller |
| 2013/0190552 | A1 | 7/2013 | Leblans |
| 2013/0272564 | A1 | 10/2013 | Miller |
| 2014/0355787 | A1 | 12/2014 | Jiles |
| 2015/0086049 | A1 | 3/2015 | Jiles |
| 2015/0110338 | A1 | 4/2015 | McCratic |
| 2015/0373456 | A1 | 12/2015 | Dayton |
| 2016/0044420 | A1 | 2/2016 | Albahri |
| 2016/0183004 | A1 | 6/2016 | Jiles |
| 2016/0198267 | A1 | 7/2016 | Jiles |

FOREIGN PATENT DOCUMENTS

| | | | |
|---|---|---|---|
| CN | 2899360 | Y | 5/2007 |
| CN | 201234336 | Y | 5/2009 |
| CN | 102428715 | A | 4/2012 |
| CN | 203840067 | | 9/2014 |
| CN | 203840177 | | 9/2014 |
| CN | 203840179 | | 9/2014 |
| CN | 203872027 | | 10/2014 |
| CN | 203933199 | | 11/2014 |
| CN | 203951282 | | 11/2014 |
| CN | 203951286 | | 11/2014 |
| CN | 203951601 | | 11/2014 |
| CN | 204046390 | | 12/2014 |
| CN | 204046391 | | 12/2014 |
| CN | 204118999 | | 1/2015 |
| CN | 204119001 | | 1/2015 |
| CN | 204119490 | U | 1/2015 |
| CN | 204145685 | U | 2/2015 |
| CN | 204168459 | | 2/2015 |
| CN | 2014168483 | U | 2/2015 |
| CN | 204291354 | | 4/2015 |
| CN | 204350281 | | 5/2015 |
| CN | 204350282 | | 5/2015 |
| CN | 204350283 | | 5/2015 |
| CN | 204350284 | | 5/2015 |
| CN | 204350285 | | 5/2015 |
| CN | 204350286 | | 5/2015 |
| CN | 105050010 | | 11/2015 |
| CN | 105340296 | A | 2/2016 |
| CN | 105453588 | A | 3/2016 |
| CN | 105684463 | A | 6/2016 |
| DE | 112014002634 | T5 | 3/2016 |
| DE | 112014002865 | T5 | 3/2016 |
| DE | 112014004371 | T5 | 6/2016 |
| DK | 178195 | B1 | 8/2015 |
| EP | 1247427 | | 11/2003 |

(56) References Cited

FOREIGN PATENT DOCUMENTS

| | | | |
|---|---|---|---|
| EP | 1281293 | B1 | 7/2010 |
| GB | 2229339 | A | 9/1990 |
| JP | 03-073099 | U | 7/1991 |
| JP | 2001268692 | A | 9/2001 |
| JP | 2006041768 | A | 2/2006 |
| JP | 2006186615 | A | 7/2006 |
| JP | 2007074499 | A | 3/2007 |
| JP | 2008141694 | A | 6/2008 |
| JP | 4876293 | | 2/2012 |
| JP | 2013138292 | | 7/2013 |
| WO | 00/74435 | A2 | 12/2000 |
| WO | 01/087008 | A3 | 11/2001 |
| WO | 2005/072009 | A1 | 8/2005 |
| WO | 2006043964 | A1 | 4/2006 |
| WO | 2006/114767 | A1 | 11/2006 |
| WO | 2013010384 | | 1/2013 |

OTHER PUBLICATIONS

International Search Report and Written Opinion; International Application No. PCT/US2014/039724; dated Sep. 24, 2014.

International Search Report and Written Opinion; International Application No. PCT/US2014/042243; dated Oct. 8, 2014.

International Search Report; International Application No. PCT/US05/000875; dated May 20, 2005.

International Search Report and Written Opinion; International Application No. PCT/US2010/034355; dated Nov. 30, 2010.

International Search Report and Written Opinion; International Application No. PCT/US2015/063713; dated Mar. 28, 2016.

Chinese Search Report with Translation for Chinese Application No. 201080020681.8; 4 pages; dated Sep. 23, 2013.

Danish Patent and Trademark Office, Search Report, Examination Report, Application No. PA 2011 70690, 6 pages.

International Search Report and Written Opinion; International Application No. PCT/US2014/056725; dated Dec. 23, 2014.

* cited by examiner

RECEIVER WITH COIL WOUND ON A STATIONARY FERROMAGNETIC CORE

CROSS-REFERENCE TO RELATED APPLICATION

This application claims the benefit of U.S. Provisional Patent Application Ser. No. 62/088,197, filed Dec. 5, 2014, entitled RECEIVER WITH COIL FREE REED which is incorporated by reference in its entirety herein.

FIELD OF THE INVENTION

This application relates to acoustic devices and, more specifically, to hearing aid receivers and their design.

BACKGROUND OF THE INVENTION

Various types of microphones and receivers have been used through the years. In these devices, different electrical components are housed together within a housing or assembly. For example, a receiver typically includes a coil, magnets, a reed, among other components and these components are housed within the receiver housing. Other types of acoustic devices may include other types of components.

In receiver applications, a coil is used to induce magnetic flux or field as electrical current is run through the coil. The magnetic field is induced into a ferromagnetic core which comprises a portion of a magnetic circuit. As the magnetic flux or field is induced into the magnetic circuit a portion of the magnetic circuit called the reed (or armature) is moved relative to the coil, this in turn moves a paddle, and sound is thereby created as the paddle moves the air. In some applications, the armature is configured to move air itself without the need of an attached paddle. The sound can consequently be presented to and heard by a listener.

In previous systems, the movable reed comprised at least a portion of the electromagnetic core of the coil, thus the coil had to be configured to provide a tunnel of space around the reed within which the reed is able to move unimpeded during normal operation of the receiver. In some versions, structures within the coil would be provided to impede motion of the reed during abnormal events such as the receiver striking a surface after being dropped. The coil would have to be constructed and assembled into the receiver with very tight tolerances, and the coils became expensive to build and complicated and expensive to integrate with the rest of the components of the receiver.

Another problem with previous approaches was that the coil was typically fit around the moving portion of the reed. Unfortunately, by winding the coil around the moving portion of the reed, the overall shape and configuration receiver was limited.

Another problem was that coils were often configured to match the electrical requirements of the specific application. With previous approaches, coils were deeply integrated into the construction of the receiver, and not removable or configurable after the initial manufacturing steps. As a result, manufacturing efficiency was lower due to lack of commonality early in the manufacturing process.

As a result of the disadvantages mentioned above, user dissatisfaction with previous approaches has resulted.

BRIEF DESCRIPTION OF THE DRAWINGS

For a more complete understanding of the disclosure, reference should be made to the following detailed description and accompanying drawings wherein.

Figure 2:
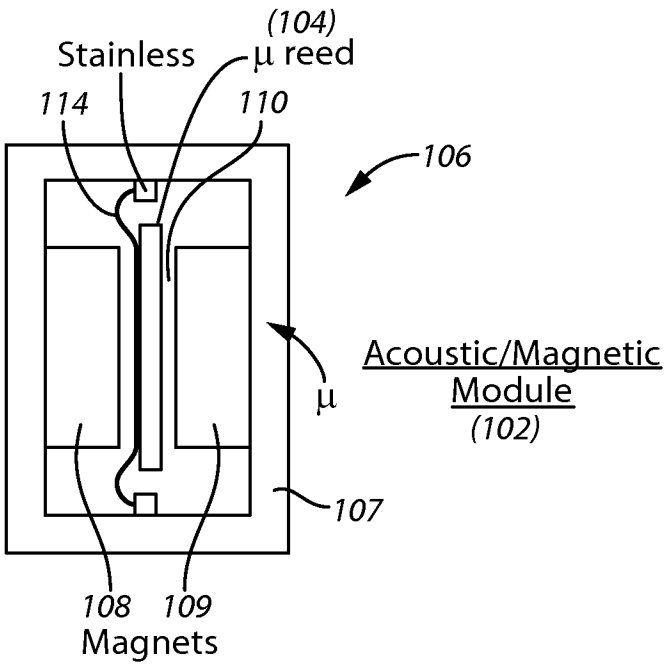
FIG. 2 comprises a top cut-away view of the yoke assembly of the receiver of FIG. 1 according to various embodiments of the present invention.
Figure 1:
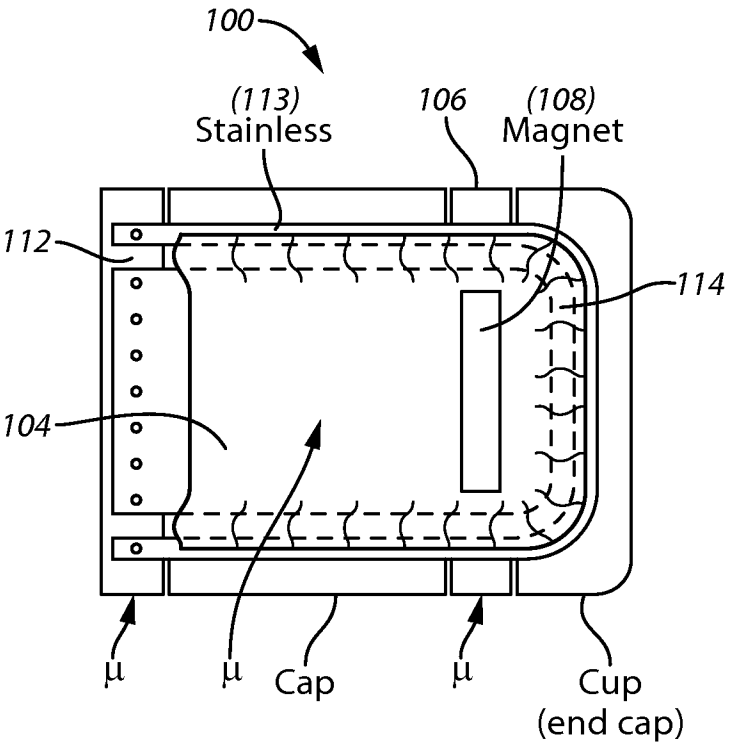
FIG. 1 comprises a top cut-away view of a receiver according to various embodiments of the present invention.
Figure 3:
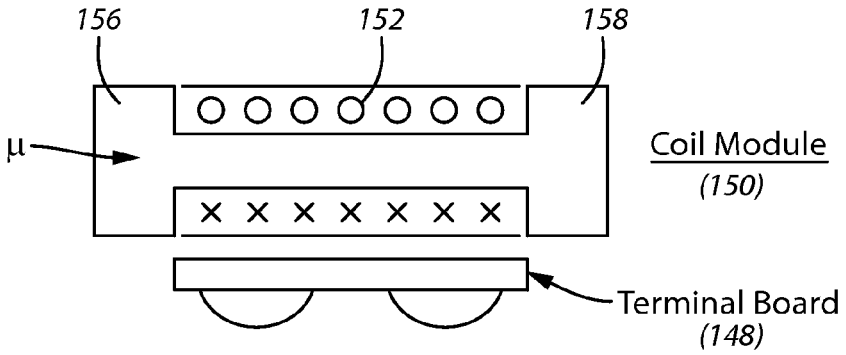
FIG. 3 comprises a top cut-away view of the coil module of the receiver of FIG. 1 according to various embodiments of the present invention.
Figure 4:
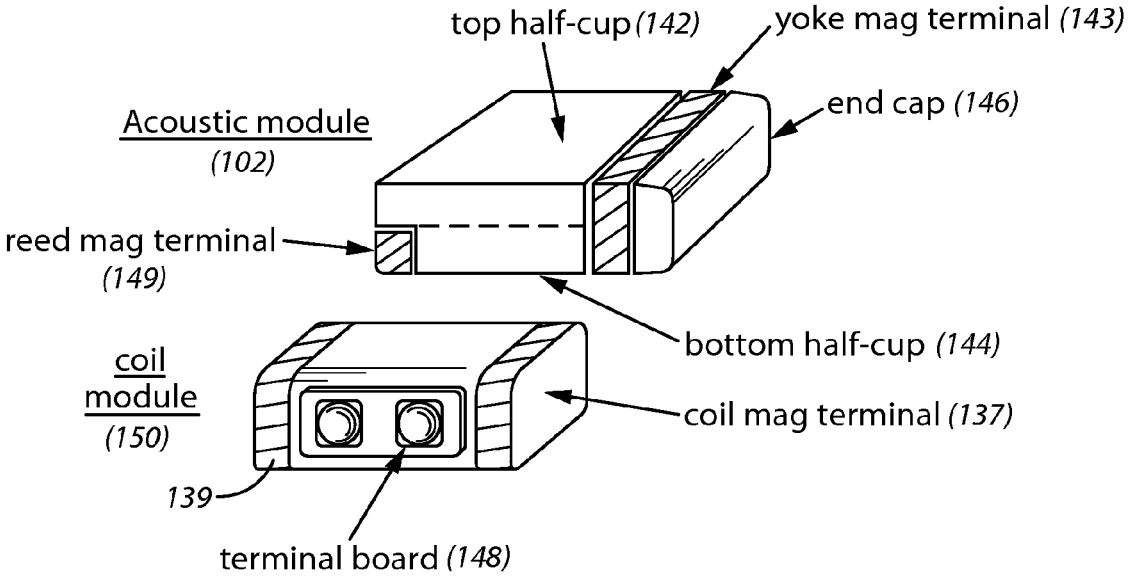
FIG. 4 comprises an external perspective view of the receiver of FIG. 1 according to various embodiments of the present invention.
Figure 5:
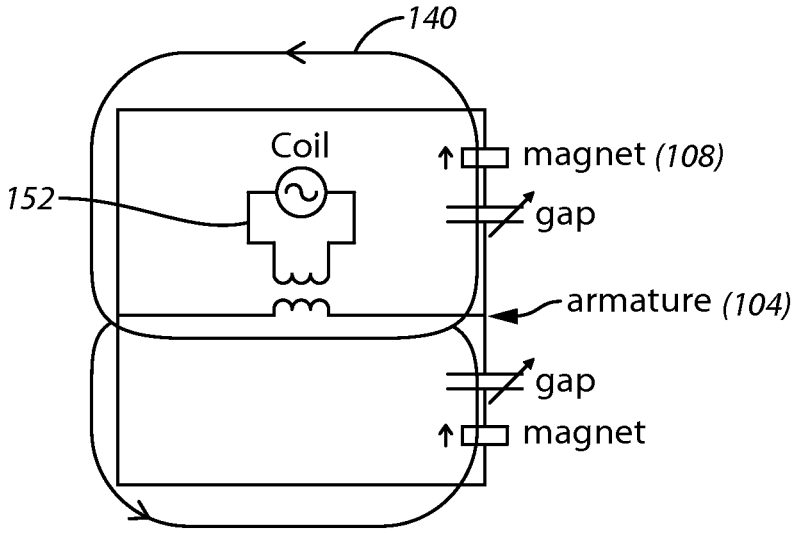
FIG. 5 comprises a magnetic circuit diagram of the receiver of FIG. 1 according to various embodiments of the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not necessarily required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Approaches are provided where one or more coils in receivers are configured to be fixedly attached to or directly wound upon a ferromagnetic core which comprises a portion of the magnetic circuit. So arranged, the coils do not require precision tolerances thereby making the coils significantly less expensive to manufacture as compared to previous coils. In addition, approaches are provided whereby one or more coils can be easily installed with other components to form a receiver module. In still another aspect, two (or potentially more) coils are provided and these coils are easily aligned with other magnetic components. The receivers provided herein have highly customizable designs, shapes, and dimensions, are easy to manufacture, and are significantly less expensive to produce as compared to previous devices.

Referring now to FIGS. 1-5, one example of a receiver 100 is described. The receiver 100 includes an acoustic module 102 and a coil module 150.

The acoustic module 102 includes a reed 104 and a yoke assembly 106. As used herein, the term "reed" is used interchangeably with "armature". In any case, the term "reed" refers to a typically thin, flat and relatively long component that moves in the presence of a changing magnetic flux. The changing magnetic flux may be created by an electrical current that passes through a coil and interacts with magnetic fields produced by permanent magnets in a yoke assembly. In one example, the reed is constructed of soft magnetic steel, or "mu-metal". Other examples of materials may be used to construct the reed. In another aspect, the reed 104 is constructed with thin and broad dimensions so as to act as a paddle. In one example, the reed 104 is 0.007 inch thin and 0.050 inch wide. One end of the reed 104 is attached (e.g., welded) to a soft magnetic steel bar 112 that protrudes from the receiver housing 142, 144, 146.

The yoke body 107 is constructed of soft magnetic steel and includes magnets 108 and 109 attached to yoke body 107. A hollow tunnel (or channel) 110 is formed and extends through the center of the yoke assembly 106. One end portion of the reed 104 extends into the tunnel 110. The other end portion of the reed 104 is attached to the bar 112. In one example, the bar is constructed of a metal.

The coil module 150 includes a coil 152. The coil 152 is wound around a soft magnetic steel core 154 that is attached to coil end portions 156 and 158. The coil module 150 couples to the acoustic magnetic module 102. It will be appreciated that since the coil module is secured to the acoustic magnetic module 102 and that the coil 152 is not wound around the moving portion of the reed 104, the coil 152 remains stationary (or substantially stationary) during operation of the receiver 100. It will be further appreciated that since the coil wire is tightly wound around the core, and that the wire is in contact with the core and does not form a tunnel within which the core could move with respect to the coil, as in previous receiver designs.

As can be seen in FIGS. 1-5, the moving portion of the reed 110 is not disposed down the axis of coil. Thus, the coil 152 does not need to be precisely placed or have a precise tolerance to avoid interference with the movement of the reed.

As mentioned and as shown, the coil 152 is not disposed on, around, or about the moving portion of the reed 104. The proximity of the coil module 150 next to the acoustic magnetic module 102 is used during operation of the receiver to create a magnetic flux path 140. As alternating current is applied to the coil 152, the flux path 140 is created by the interaction of the electrical current in the coil and magnetic fields created by the permanent magnets 108 and 109. The flux path 140 moves the reed 104. More specifically, as the reed 104 moves, the air about the reed 104 moves thereby creating sound. In other words, the reed 104 acts as a diaphragm and no separate diaphragm element is needed. The sound tube receives the produced sound for presentation to a user.

In one aspect, the magnetic flux path 140 is closed and carries all static flux plus the worst case dynamic flux. The dynamic flux produced by the coil 152 splits the gap/channel 110 in twain, and has closed paths without requiring shunts.

The coil module 150 is a self-contained unit. The coil 152 is wire that is wound on a micro-metal core, encapsulated except on one face where micro-metal is exposed. A terminal is attached to coil module 150 to provide an electrical interface to the coil wire.

It will be appreciated that the receiver 100 can be easily customized by replacing coil module 150. Thus, the size, shape, dimensions, performance characteristics, among other features of the coil module 150 can be customized to the particular needs and requirements of a particular acoustic module 102.

The receiver 100 includes a top half cup housing portion 142, a bottom half-cup housing portion 144, and an end cap housing portion 146. The housing portions 142, 144, and 146 cannot be constructed of ferromagnetic materials but are instead constructed of some non-ferromagnetic material (such as plastic or hard stainless steel) that will not short the magnetic circuit. A terminal board 148 couples to the coil module 150 and provides a connection with external components. A reed magnetic terminal 149 extends from the bottom cup housing portion 144. Yoke magnetic terminals 143 are exposed. The coil module has terminals 137 and 139 which couple respectively to terminals 149 and 143. In so doing, the magnetic flux path 140 can be created.

In one example, a manufacturing process for creating the receiver 100 includes welding the thin, wide reed 104 to the bar 112. In one aspect, the reed 104 may have a pie-pan shape to prevent flexing. Other examples of shapes may also be used. Then, a ring 113 welded to bar 112. A thin film 114 is attached to ring 113 and reed 104.

The yoke assembly 106 (including the yoke body 107, and magnets 108 and 109) is placed over the reed 104. In this respect, the position of the yoke assembly 106 is adjusted to center the reed 104 in the channel 110. The yoke assembly 106 is affixed to the bottom half cup housing portion 144, for example, using welding or glue. The top half-cup housing portion 142 and the end cap housing portion 106 are added (attached). The magnetic terminals (i.e., the exposed side of bar and yoke) are polished so as to provide an adequate magnetic connection.

The use of the detachable coil module 150 makes the present approaches highly customizable. In this respect, an appropriate coil module can then be attached to the module 102. In addition, the cup housing portions mentioned above can also be exchanged out, for instance, to create more back volume in the receiver 100 as needed. For instance, housing portions having different dimensions, shapes, and configurations can be fitted to the particular needs of a particular receiver. In one example, a housing portion providing an increased back volume may be used to improve the performance characteristics of the receiver 100. It will be appreciated that the cup housing portions 142, 144, and 146 are the primary structured members of the receiver 100.

Figure 6:
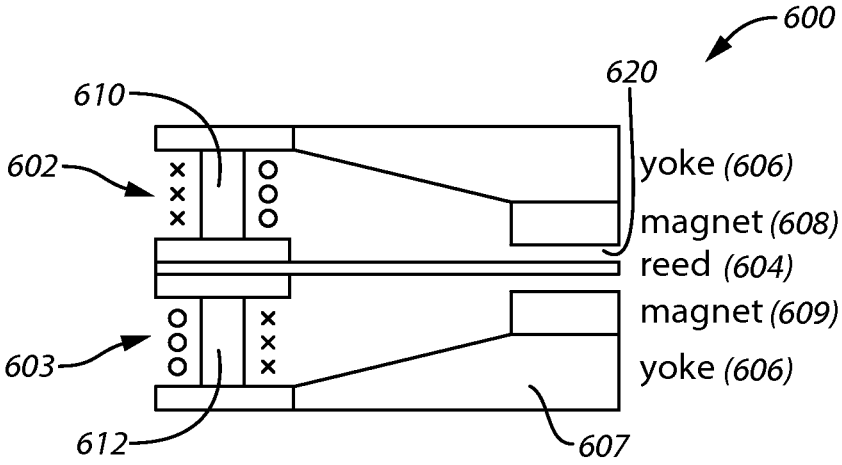
FIG. 6 comprises a top-cut-away view of a two-coil receiver according to various embodiments of the present invention.
Figure 7:
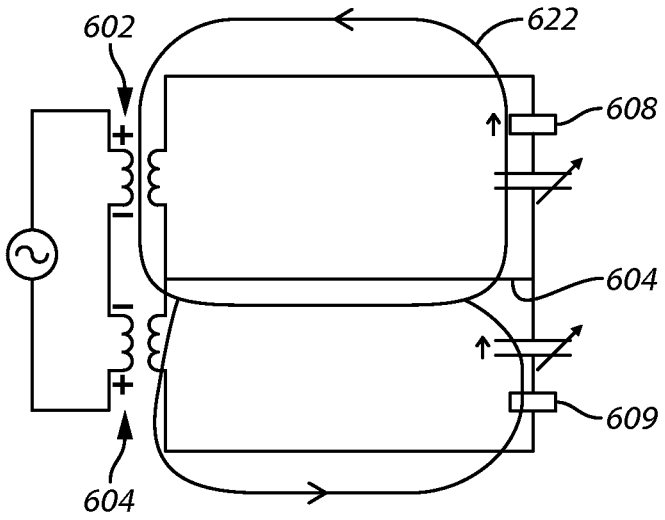
FIG. 7 comprises a magnetic circuit diagram of the receiver of FIG. 6 according to various embodiments of the present invention.

Referring now to FIG. 6 and FIG. 7, a receiver motor 600 with two coils is described. As shown, the receiver has a first coil 602 and a second coil 603. The coils 602 and 603 include coil cores 610 and 612 and the coil cores 610 and 612 carry the static flux as well as the dynamic flux that is created during operation of the receiver 600. The receiver 600 includes a reed 604, a yoke assembly 606 (that includes a yoke body 607, a first magnet 608, and a second magnet 609). It can be appreciated that all the sources of magnetic radiation in the receiver 600 (i.e., the coil and magnets) are aligned. A tunnel 620 is disposed through the yoke assembly 606 and extends between the magnets 608 and 609. In one aspect, the reed 604 is secured between the coils 602 and 603 and extends between the gap created by the tunnel 620 between the magnets 606 and 608.

As can be seen in the receiver of FIGS. 6 and 7, the coils 602 and 603 are not disposed around the moving part of the reed 620. Thus, the coils 602 and 603 do not need to be precisely placed or be constructed with precise tolerances. It will also be understood that although two coils are shown in this example (as well as the example of FIGS. 8 and 9), any number of coils may be used.

In one example of the operation of the system of FIG. 6 and FIG. 7, an alternating electrical current is generated and flow through the coils 602 and 603. The flow of the alternating electrical current through the coils 602 and 603 interacts with the magnetic field produced by the magnets 608 and 609 to generate a magnetic flux. The magnetic flux flows in a direction indicated by the arrow labeled 622 down the reed 604 and moves the reed 604. Reed 604 may then be attached to a paddle of a receiver, not show in FIG. 6.

Figure 8:
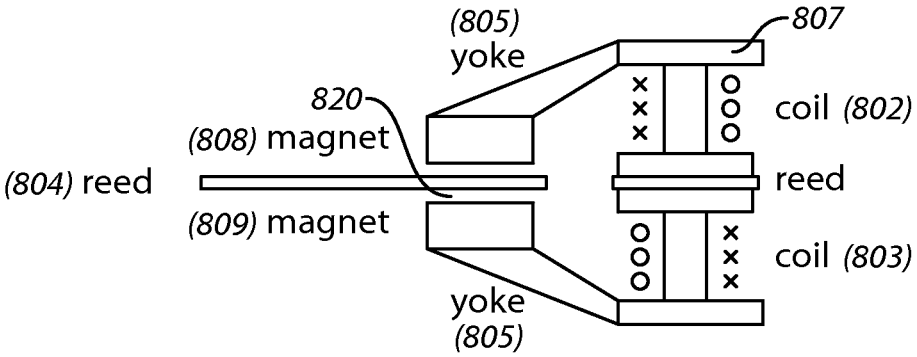
FIG. 8 comprises a top cut-away view of another example of a two-coil receiver according to various embodiments of the present invention.
Figure 9:
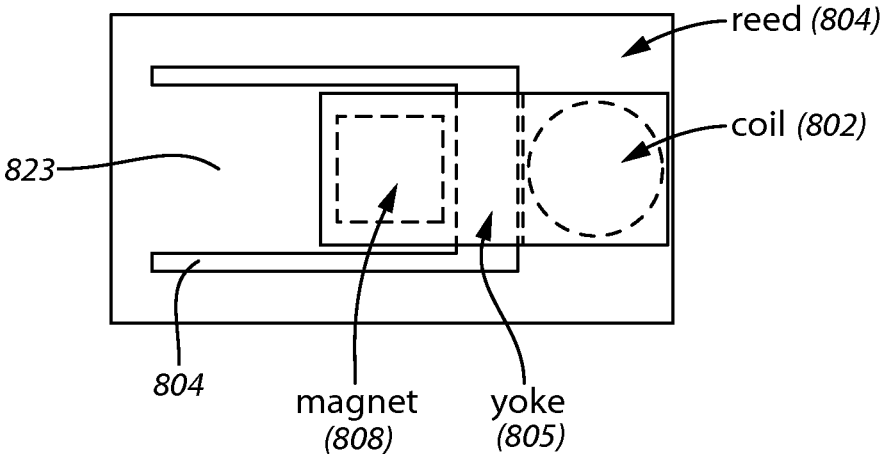
FIG. 9 comprises a side cut-away view of two-coil receiver of FIG. 8 according to various embodiments of the present invention.

Referring now to FIGS. 8 and 9, another example of a receiver 800 with two coils is described. As shown, the receiver 800 includes a first coil 802 and a second coil 803. The coils 802 and 803 are wound about coil cores 810 and 812 and the coil cores 810 and 812 carry the static flux as well as the dynamic flux during operation of the receiver 800. The receiver 800 includes a reed 804, a yoke assembly 805 (that includes a yoke body 807, a first magnet 808, and a second magnet 809). It can be appreciated that all the sources of magnetic radiation in the receiver 800 (i.e., the coils and the magnets) are aligned. A tunnel 820 is formed in the yoke assembly 805 between the magnets 806 and 808. The reed 804 is secured between coils and has a tongue 823 that extends in the tunnel 820. An opening 821 extends through the reed 804.

As can be seen in FIGS. 8 and 9, the coils 802 and 803 are disposed out of the tunnel 820. Thus, the coils 802 and 803 do not need to be precisely placed or be constructed with precise tolerances.

In one example of the operation of the system of FIG. 8 and FIG. 9, an alternating electrical current is generated and flow through the coils 802 and 803. The flow of the alternating electrical current through the coils 802 and 803 interacts with the magnetic field produced by the magnets 808 and 809 to generate a magnetic flux. The magnets and coils are contained within a yoke assembly 805. The magnetic flux flows in a direction indicated by the arrow labeled 622 (in FIG. 6 which is also the equivalent magnetic circuit for the devices shown in FIG. 8 and FIG. 9) down the reed 804 and acts to move the tongue 823 of the reed 804. Consequently, the reed 804 (and its tongue 823) acts as a diaphragm. As the reed 804 moves, the air around the reed 804 is moved thereby creating sound. The sound moves through the sound tube of the receiver 800 and after it exits the sound tube can be presented to a user.

It will be appreciated that in the approaches described herein, the sources of magnetic radiation are aligned. Because of the alignment, there is a much greater control of this magnetic radiation as compared to previous approaches. For instance, the amount and direction of created magnetic flux is better controlled.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A receiver comprising:

an acoustic module, wherein the acoustic module includes a first housing, a plurality of magnets, and an armature, the armature disposed within the first housing and extending between the plurality of magnets; and a coil module coupled to the acoustic module through terminals that provide a magnetic flux path from the coil module to the acoustic module, wherein the coil module is physically separate from the acoustic module and includes a second housing and a coil, the coil disposed within the second housing and not surrounding the armature;

wherein the coil is excitable by an electrical current representative of acoustic energy and excitation of the coil produces a magnetic flux path which moves the armature.

2. The receiver of claim 1, wherein the acoustic module is detachable from the coil module.

3. The receiver of claim 1, wherein the armature is 0.007 inches in thickness and 0.050 inches wide.

4. The receiver of claim 1, wherein the coil comprises a wire that is wound around a micro-metal core.

5. The receiver of claim 1, wherein the first housing and the second housing are constructed of a non-ferromagnetic material.

6. The receiver of claim 1, wherein one or more of the acoustic module and the coil module are interchangeable with other acoustic modules and coil modules.

7. A dual coil receiver comprising:

a first coil disposed on a first supporting structure;

a second coil disposed on a second supporting structure;

a yoke coupled to one or more magnets; and an armature, wherein a first end of the armature is mounted between the first supporting structure and the second supporting structure such that the first coil and the second coil do not surround the armature;

wherein excitation of one or more of the first coil and the second coil produces a magnetic flux path which moves the armature.

8. The dual coil receiver of claim 7, wherein the one or more magnets include two magnets, the two magnets form a gap there between, and a second end of the armature extends through the gap.

9. The dual coil receiver of claim 7, wherein the first coil comprises wire wound about the first supporting structure and the second coil comprises wire wound about the second supporting structure.

* * * * *